United States Patent [19]

Henzl et al.

[11] 4,058,143

[45] Nov. 15, 1977

[54] CONSTANT TENSION REGULATOR OF POSITIVELY UNWOUND FLEXIBLE MATERIAL, PARTICULARLY WARP THREADS IN WEAVING MACHINES

[75] Inventors: Jindrich Henzl; Jindrich Cerny; Jaromir Malasek, all of Brno, Czechoslovakia

[73] Assignee: Vyzkumny a vyvojovy ustav Zavodu vseobecneho strojirenstvi, Brno, Czechoslovakia

[21] Appl. No.: 679,376

[22] Filed: Apr. 22, 1976

[30] Foreign Application Priority Data

Apr. 22, 1975 Czechoslovakia ..... 2775/75

[51] Int. Cl.[2] ..... D03D 49/06

[52] U.S. Cl. ..... 139/110

[58] Field of Search ..... 139/105, 109, 110; 66/86 L; 226/24, 30, 42; 242/75

[56] References Cited

U.S. PATENT DOCUMENTS

| | | | |
|---|---|---|---|
| 3,630,239 | 12/1971 | Hooper | 139/110 |
| 3,753,451 | 8/1973 | Hosono et al. | 139/110 |
| 3,810,493 | 5/1974 | Mizuno | 139/110 |
| 3,930,523 | 1/1976 | Garcia | 139/110 |

*Primary Examiner*—Henry S. Jaudon

[57] ABSTRACT

A constant tension regulator for controlling the tension of positively unwound flexible material, particularly warp threads in a weaving machine. Means are operatively mounted on the frame of the regulator for sensing changes in tension in the unwinding flexible material. These sensing means output a control movement in accordance with sensed tension in the unwinding flexible material which is translated to a mechanical integrating unit and a proportional adjusting unit, arranged in parallel, which jointly transmit a control variable adjustment to the driving means of the warp beam thereby adjusting its rotary speed in accordance with the sensed tension.

8 Claims, 3 Drawing Figures

CONSTANT TENSION REGULATOR OF POSITIVELY UNWOUND FLEXIBLE MATERIAL, PARTICULARLY WARP THREADS IN WEAVING MACHINES

BACKGROUND OF THE INVENTION

The present invention relates to a constant tension regulator of positively unwound flexible material, particularly of warp threads in weaving machines.

Machines are known in which it is necessary to rewind flexible material from one beam to another under constant tension. Usually, the sensing means for the constant tension value of the flexible material takes the form of a cylinder or a roller over which said material is guided. The cylinder is generally swingably mounted on a resilient swingable lever, which simultaneously exerts pressure and thereby tension upon the said flexible material. The difference between the winding speed of the flexible material on the drawing beam and its unwinding speed from the beam, which is generally due to variations in the machine operation, causes changes in tension.

This problem is encountered particularly in weaving machines. The warp threads are mounted on a warp beam in the weaving machine and unwound therefrom. After interlacing weft thread, a fabric is formed which is drawn by the withdrawing beam. The tension on the warp threads should have an optimum constant value.

For the purpose of achieving this condition, a regulator is needed. In weaving machines such a sensor generally takes the form of a cylinder which bears against the threads being unwound from the warp beam. Let-off motions of the unwinding warp threads for detecting variations of tension by the sensor are used, i.e., a cylinder or roller on a resilient swingable lever. A variable speed gear box is operatively connected to the cylinder and is the main member of such a regulator. The variable speed gear box is generally controlled via a transmission member with the cylinder or roller. The output shaft of the variable speed gear box drives the warp beam via a transmission mechanism. In this type of regulator, a direct dependence, that is, a proportional dependence, is encountered between the deviation of the back rest (i.e., the cylinder or roller) and the adjustment of the angular velocity of the output shaft of the regulator. Thus the regulator has strictly a proportional behavior which is disadvantageous. This deviation of the cylinder or roller increases due to the decrease of the warp threads winding radius on the warp beam in the course of weaving which causes a higher number of yarn breakages and consequently a lower quality of the fabric obtained.

SUMMARY OF THE INVENTION

It is a general object of this invention to provide a regulator which overcomes the aforedescribed disadvantages of the tension regulators of the state of the art. The device of the invention is a constant tension regulator for a positively unwinding flexible material, particularly warp threads in a weaving machine. The device includes a sensor of the tension value which responds to changes thereof by changing the magnitude of a command variable and changes the angular velocity of a drive shaft. The tension sensor is connected to a mechanical integrator and a proportional adjustor arranged in parallel, said integrator and proportional adjustor being connected via a common adding mechanism to the command variable thereby controlling the output final control element.

The main advantage of the regulator according to the present invention resides in controlling the tension of the unwound material while maintaining its constant tension value and securing a constant position of the tension sensor even when the radius of winding on the beam changes, or the unwinding speed of the flexible material changes.

BRIEF DESCRIPTION OF THE DRAWING

A preferred embodiment of the present invention in the form of an example is shown in the accompanying drawings, in which.

DETAILED DESCRIPTION

Figure 1:
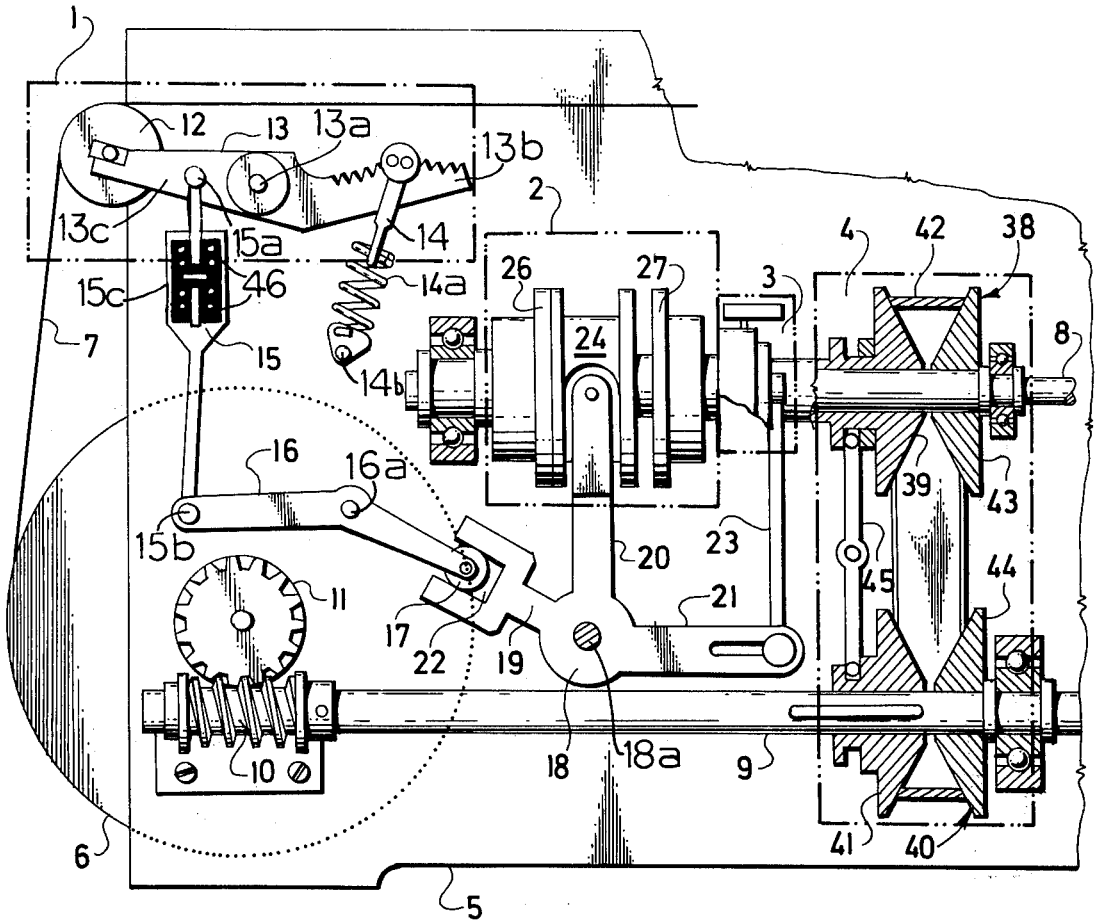
FIG. 1 is a schematic elevational view of a part of the weaving machine with the overall arrangement of the constant tension regulator for warp threads.

Referring now to the drawings, there is illustrated in FIG. 1 an exemplary embodiment of the present invention. The embodiment is in the form of a constant tension regulator of warp threads in a weaving machine. The whole device is arranged on frame 5 of the machine. The regulator includes a sensor 1 for sensing the tension of warp threads 7 and responds to changes in tension in the warp threads by changing its position, i.e, by a deviation. The sensor 1 is connected to an integrator 2 and to a proportional adjustor 3 which are connected to each other in parallel. The outputs of said integrator 2 and adjustor 3 are added and transmitted to the control member of the final control element 4 which includes a variable speed gear box. This control element 4 responds to the change of position of its control member by a change in angular velocity of its output shaft 9 which is connected by a mechanical transmission, a worm 10 and a worm gear 11 to the warp beam. The controlled warp threads 7 are thus unwound from warp beam 6, which is rotatably mounted on frame 5 of the machine. From the warp beam 6 warp threads 7 are guided via sensor 1 of the regulator and not shown healds of heald shafts, the reed, the weft inserting mechanism and, in the form of a fabric, to the withdrawing beam and the remaining known parts of a weaving machine.

Sensor 1 of the regulator is formed by a back rest cylinder 12 rotatably mounted on one arm **13*c* of a two-arm lever 13. This lever 13 is pivotally mounted on frame 5 of the machine on a pivot shaft 13*a*. To the other arm 13*b* of the two-arm lever 13 there is adjustably connected a member 14. This member 14 is pivoted at 14*b* on the machine frame 5 and includes a spring 14*a* for the purpose of adjusting the tension of warp threads 7. A tie rod 15 is pivotally connected at pivot 15*a* to the arm 13*c* of the two-arm lever 13. The tie rod 15 is pivotally connected at its other end 15*b* to a swingable two-arm lever 16 which is also pivoted on the machine frame 5 at 16*a*. A three-arm lever 18, which is swingably mounted on frame 5 of the machine at pivot 18*a*, has a first arm 19 which is provided with a recess 22, into which engages roller 17 rotatably supported on the two-arm lever 16. The second arm 20 of three-arm lever 18 is operatively connected to the mechanical integrator 2 in a manner to be described below. A third arm 21** of the three-arm lever 18 is connected in a manner to be described below to a proportional adjustor 3, e.g. by means of a tie rod 23.

Figure 2:
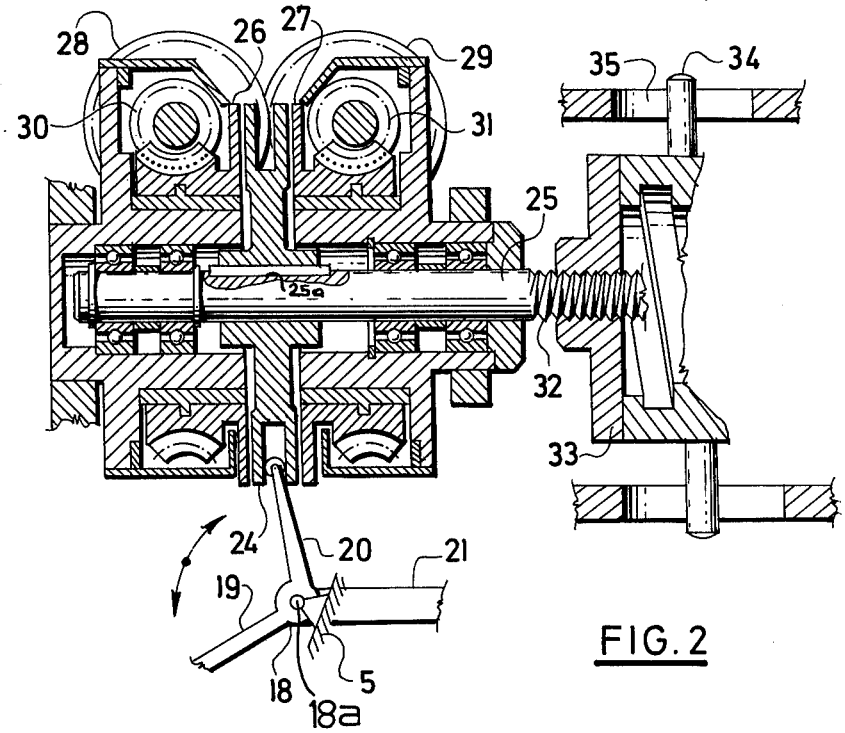
FIG. 2 is a schematic cross-sectional elevation of the mechanical integrator.

The mechanical integrator 2 (see FIG. 2) is formed by disc 24 which is mounted displaceably and non-rotatably, e.g, in the grooves 25*a* on a shaft 25 which is rotatably mounted in the machine frame 5. Disc 24 is mounted with a clearance which may be adjustable by non-illustrated means, displaceably between two clutch discs 26 and 27 which positively rotate relative to each other in mutually opposite directions. The positive drive is made, e.g., by means of a fixed transmission (not illustrated) from the rotary motion of the weaving machine to gear wheels 28, 29 via worm gearing 30, 31. At the end of rotary shaft 25 is a movable thread 32 on which is mounted an output member 33 which is axially movable in the machine frame 5 but is secured against rotation by pins 34 in guideway 35.

Figure 3:
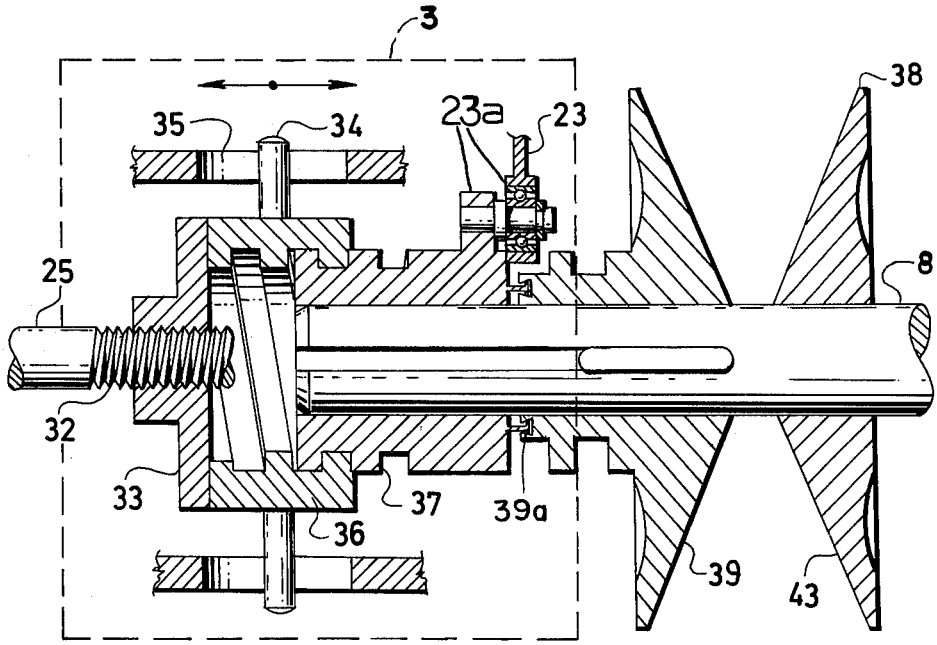
FIG. 3 is a schematic cross-section elevation of the proportional adjustor.

The proportional adjustor 3 of the regulator (see FIG. 3) is formed by an axially movable nut 36 which is firmly connected to output member 33 of the mechanical integrator 2 and is together therewith secured against rotation. The nut 36 has an internal thread with which a displaceable screw 37 meshes. The screw 37 is connected to the third arm 21 of the three-arm lever 18 by means of a pivot connection 23*a* and tie rod 23. The movement of this displaceable screw 37 constitutes the output of the proportional adjustor 3 of the regulator. In view of the threaded connection between the movement nut 36 and the shaft 25 (whose rotary movement represents the output of the mechanical integrator 2 of the regulator) an addition of the outputs of the units 2 and 3 is obtained. This output sum is transferred to the control member of the final control unit 4 of the regulator. This transfer is performed in such manner that the displaceable screw 37 is mounted rotatably on the input shaft 8 of the variable speed gear box forming part of the final control unit 4 and is adapted to impart an axial movement to part 39 of the pulley 38 by means of a pin and slot connection 39*a* (FIG. 3). The variable speed gear box has one pair of pulleys 38, 40 interconnected by belt 42. One pulley 38 is arranged on input shaft 8, the second pulley 40 is arranged on the output shaft 9 of the variable speed gear box. Each pulley 38, 40 has its fixed part 43, 44, and has a part 39, 40 which is axially displaceable but non-rotatable, on its corresponding shaft 8, 9 by means, for example, of a key. The displaceable parts 39, 41 of pulleys 38, 40 are connected by connecting lever 45 which is pivoted at 45*a* on the machine frame 5. The axial displacement of the displaceable part 39 of the first pulley 38 is transferred to the displaceable part 41 of the second pulley 40 via the connecting lever 45 which thereby is axially displaced in the opposite direction and the gear ratio is accordingly changed, i.e., the angular velocity of output shaft 9 is changed.

The displaceable screw 37, i.e., the common adding means for the mechanical integrator 2 and proportional adjustor 3 of the regulator is rotatably mounted on the shaft 8 and is axially displaceable to axially move part 39 of the first pulley 38 (which means that it can impart an axial but not a rotational movement thereto). The part 39 is actually a control member of the final control element 4 of the variable speed gear box.

Between sensor 1 of the regulator and the parallelly arranged mechanical integrator 2 and proportional adjustor 3 there can be arranged an inertia element, which is embodied in FIG. 1 as member 15*c* on the tie rod 15 of sensor 1, of a pair of coaxially arranged springs 46 which filter the transmission of the deviation of the back rest cylinder 12 to the units 2, 3 of the regulator.

The whole device operates during weaving machine operation as follows:

The warp threads 7 are continuously unwound from warp beam 6 and when no disproportion takes place between the unwinding speed and the withdrawing speed of the said warp threads, sensor 1 and back rest cylinder 12 remain in their preset positions and the angular velocity of the output shaft of the variable speed gear box is constant. The mechanical integrator 2 and the proportional adjustor 3 are at rest during such an operative condition. When the tension of warp threads 7 changes, the back rest cylinder 12 changes its position. This positional change is transferred by the lever transmission formed by the tie rod 15, two-arm lever 16 and three-arm lever 18 to the units 2 and 3. Therefore, the deviation of the position of back rest cylinder 12 is transmitted (see FIG. 1), on the one hand, into the mechanical integrator 2 and, on the other hand, into proportional adjustor 3. This deviation is transmitted in the mechanical integrator 2 to the clutch plate or disc 24 which becomes engaged, according to the sense of the deviation, with one of the clutch discs 26 or 27, the result being a corresponding change of the position of its output member 33 by virtue of the threadable engagement between threaded portion 32 of shaft 25 and the output member 33.

In the proportional adjustor 3, this deviation is transmitted by the tie rod 23 to the displaceable screw 37 and the result is a change of its position in the axial direction, to which is added the change of the position of output member 33 of integrator 2. The result is a change of position of the control member, that is, the displaceable part 39 of pulley 38 on the input shaft 8 of the variable speed gear box drive, with a following change in angular velocity of output shaft 9 of the variable speed gear box, and thus the angular velocity of the unwinding beam 6. Upon compensating the tension of warp threads 7, i.e., upon compensating the deviation of the position of back rest cylinder 12, the control member, that is, the displaceable part 39 of pulley 38, does not return into the position before the deviation of the position of back rest cylinder 12 because the change of position of output 33 of integrator 2 of the regulator is irreversible in view of its integrating behavior. In contradistinction thereto, the deviation of the proportional adjustor 3 of the regulator is reversible. Consequently, the deviation from the proportional adjustor 3 is proportional to the deviation of the position of back rest cylinder 12 and the deviation from the mechanical integrator 2 is proportional to the total time of the deviations of the position of back rest cylinder 12.

When these deviations are so added and brought to the control member 39 of the final control 4 of the variable speed gear box, then the angular output velocity is proportional to the momentary deviation of the position of back rest cylinder 12 and the total time of deviations in position of the back rest cylinder 12. The regulator has, consequently, a proportional integrating behavior. Thus, the same mean position of the back rest cylinder 12 is secured even when the winding radius of warp threads 7 on warp beam 6 changes, said cylinder being stable in a stabilized condition, i.e., not oscillating about a mean position.

The instant preferred embodiment should be considered as illustrative of the present invention and it should be understood that it can be varied in different manners within the scope of the invention.

The present invention can be advantageously applied universally wherever wound flexible material is to be unwound under constant tension.

Although the invention is illustrated and described with reference to a single preferred embodiment thereof, it is to be understood that the invention is in no way limited by the disclosure of such a single preferred embodiment, but that it is capable of numerous modifications within the scope of the appended claims.

What is claimed is:

1. A constant tension regulator for controlling the tension of positively unwound flexible material such as warp threads, comprising in combination, a support frame, a warp beam rotatably supported in said frame and adapted to unwind a plurality of warp threads therefrom, sensing means contacting said plurality of unwinding warp threads to thereby sense the variations in tension in said threads, a change in tension in said threads causing a change of position of at least a portion of said sensing means;

an integrating unit operatively mounted in said frame and adapted to effect a first output corresponding to said change of position of said sensing means;

a proportional adjusting unit operatively mounted in said frame and adapted to effect a second output corresponding to said change of position of said sensing means;

means operatively connecting said integrating unit and proportional adjusting unit to said sensing means, said integrating unit and proportional adjusting unit having common means for adding said first and second outputs; and a control member operatively connected, on the one hand, to said warp beam, and, on the other hand, to said common means to thereby adjust the unwinding speed of said warp beam in accordance with the tension sensed in said threads.

2. The constant tension regulator for controlling the tension of positively unwound flexible material as set forth in claim 1, wherein said means operatively connecting said integrating unit, proportional adjusting unit and sensing means includes a three-arm lever pivotally mounted on said machine frame, each arm of said three-arm lever being operatively connected to one of said units and said sensing means.

3. The constant tension regulator for controlling the tension of positively unwound flexible material as set forth in claim 1, wherein said integrating unit comprises, in combination, a first shaft rotatably mounted in said machine frame;

a pair of clutch discs rotatably axially mounted on said first shaft;

a friction disc non-rotatably axially mounted on said first shaft between said pair of clutch discs and adapted to be placed selectively into frictional contact with one of said pair of clutch discs and to be rotated by it and thereby rotating said first shaft;

means operatively connected to said pair of clutch discs and adapted to rotate them about said first shaft in opposite directions, said first shaft having a threaded portion; and an output member threadably non-rotatably but axially movably mounted on said first shaft, said output member having an internally threaded portion.

4. The constant tension regulator for controlling the tension of positively unwound flexible material as set forth in claim 3, wherein the clearance between said pair of clutch discs and said friction disc is adjustable.

5. The constant tension regulator for controlling the tension of positively unwound flexible material as set forth in claim 3, wherein said output member and said internally threaded portion are rigidly secured to each other.

6. The constant tension regulator for controlling the tension of positively unwound flexible material as set forth in claim 3, wherein said proportional adjusting unit comprises a screw member which meshes with said internally threaded non-rotatable portion and moves axially when rotated relative thereto, the axial movements of said internally threaded portion and said screw member being imparted to said control member which adjusts the winding speed of said warp beam accordingly.

7. The constant tension regulator for controlling the tension of positively unwound flexible material as set forth in claim 6, wherein said common means for adding said first and second outputs includes said threaded portion of said first shaft, said output member having said internally threaded portion and said screw member.

8. The constant tension regulator for controlling the tension of positively unwound flexible material as set forth in claim 7, wherein said control member includes variable speed gearing means operatively connected to said warp beam to adjust the unwinding speed thereof in accordance with the adjustment received from said common means.

* * * * *